US007759877B2

(12) United States Patent
Bai et al.

(10) Patent No.: US 7,759,877 B2
(45) Date of Patent: Jul. 20, 2010

(54) DRIVING SYSTEM FOR ELECTRONIC DEVICE AND CURRENT BALANCING CIRCUIT THEREOF

(75) Inventors: Shwang-Shi Bai, Tainan County (TW); Shu-Ming Chang, Tainan County (TW); Hsiu-Na Hsieh, Tainan County (TW)

(73) Assignee: Himax Technologies Limited, Sinshih Township, Tainan County (TW)

( * ) Notice: Subject to any disclaimer, the term of this patent is extended or adjusted under 35 U.S.C. 154(b) by 366 days.

(21) Appl. No.: 11/927,692

(22) Filed: Oct. 30, 2007

(65) Prior Publication Data

US 2009/0108771 A1 Apr. 30, 2009

(51) Int. Cl.
*H05B 41/24* (2006.01)

(52) U.S. Cl. ..... 315/277; 315/276; 315/279; 315/224; 315/312

(58) Field of Classification Search ..... 315/276–278, 315/294, 312, 313, DIG. 5, 279, 224, 291, 315/307; 345/102
See application file for complete search history.

(56) References Cited

U.S. PATENT DOCUMENTS

| | | | | |
|---|---|---|---|---|
| 6,420,839 | B1 * | 7/2002 | Chiang et al. | 315/311 |
| 6,534,934 | B1 | 3/2003 | Lin | |
| 6,661,181 | B2 * | 12/2003 | Shin | 315/169.4 |
| 7,190,128 | B2 * | 3/2007 | Chen et al. | 315/312 |
| 7,309,964 | B2 * | 12/2007 | Wey et al. | 315/312 |

* cited by examiner

*Primary Examiner*—Douglas W Owens
*Assistant Examiner*—Ephrem Alemu
(74) *Attorney, Agent, or Firm*—Winston Hsu

(57) ABSTRACT

A driving system, includes: a power supply unit for providing a first current and a second current; a first transformer having a primary side coupled to the power supply unit and a secondary side coupled to a first current balancing circuit for driving a plurality of first lamps; a second transformer having a primary side coupled to the power supply unit and a secondary side coupled to a second current balancing circuit for driving a plurality of second lamps; a balancing control circuit coupled to the power supply unit for balancing the first and the second current so that the first current and the second current are substantially equal.

14 Claims, 5 Drawing Sheets

DRIVING SYSTEM FOR ELECTRONIC DEVICE AND CURRENT BALANCING CIRCUIT THEREOF

BACKGROUND OF THE INVENTION

1. Field of the Invention

The present invention relates to a driving system for electronic devices, and particularly relates to a driving system for lamps.

2. Description of the Prior Art

Conventional back light modules of a flat panel display always utilize at least one CCFL (Cold Cathode Fluorescent Lamp) as a light source. However, since the number of lamps follows the size of the flat panel display, the luminance and uniform degree are severely requested. Furthermore, each CCFL may have different characteristics, and therefore may have different passing currents and luminance even though the same voltage is provided to each CCFL. Thus, a current balancing mechanism is needed.

FIG. 1 and FIG. 2 illustrate prior art current balancing circuits for lamps. As shown in FIG. 1, the current balancing circuit 100 includes a power stage 101, a transformer 103, a control circuit 105, and capacitors 107 and 109. The power stage 101 is utilized to provide an AC voltage $V_1$ according to a DC voltage $V_{in}$. The transformer 103 is utilized to transform the AC voltage $V_1$ to an AC voltage $V_2$. Thereby the lamps 111 and 113 can obtain currents according to the AC voltage $V_2$. The control circuit 105, which is always a PWM control circuit, is utilized to control the power stage according to the currents $I_1$, $I_2$. As described above, even though the lamps 107, 109 are provided with the same voltages, they may have different passing currents $I_1$, $I_2$ due to their different resistances.

FIG. 2 illustrates a prior art current balancing circuit 200 for lamps. The current balancing circuit 200 has similar structures with the current balancing circuit 100. The most apparent difference is that the current balancing circuit 200 has two power stages 201, 203, which provide currents to lamps 205 and 207, respectively. As shown in FIG. 2, the two power stages 201, 203 make the current balancing circuit 200 more complicated than the current balancing circuit 100. Accordingly, the current balancing circuit 200 is hard to be controlled by the control circuit. Besides, such structure also results in an increase of cost and space.

SUMMARY OF THE INVENTION

Therefore, one objective of the present invention is to provide a current balancing circuit, which can provide balanced currents to lamps without increasing the complexity of the circuit.

One embodiment of the present invention discloses a driving system, which comprises: a power supply unit for providing a first current and a second current; a first transformer having a primary side coupled to the power supply unit and a secondary side coupled to a first current balancing circuit for driving a plurality of first lamps; a second transformer having a primary side coupled to the power supply unit and a secondary side coupled to a second current balancing circuit for driving a plurality of second lamps; a balancing control circuit coupled to the power supply unit for balancing the first and the second current so that the first current and the second current are substantially equal.

Another embodiment of the present invention discloses another driving system, which comprises: a power supply unit comprising a first power stage, a second power stage and a third power stage for providing a first current, a second current and a third current respectively; a first transformer having a primary side coupled to the first power stage and a secondary side coupled to a first current balancing circuit for driving a plurality of first lamps; a second transformer having a primary side coupled to the second power stage and a secondary side coupled to a second current balancing circuit for driving a plurality of second lamps; a third transformer having a primary side coupled to the third power stage and a secondary side coupled to a third current balancing circuit for driving a plurality of third lamps; a balancing control circuit comprising a first, a second and a third balancing transformers, each of the first, second and third balancing transformer having a primary side and a secondary side, wherein each primary side of the first, second and third balancing transformer respectively coupled to the first, the second and the third power stage and each secondary side of the first, second and third balancing transformer forming a closed loop so that the first, the second and the third currents are substantially equal.

According to the above-mentioned circuit, the current balancing circuit can provide the same circuits to the lamps without increasing the complexity of the circuit.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 1:
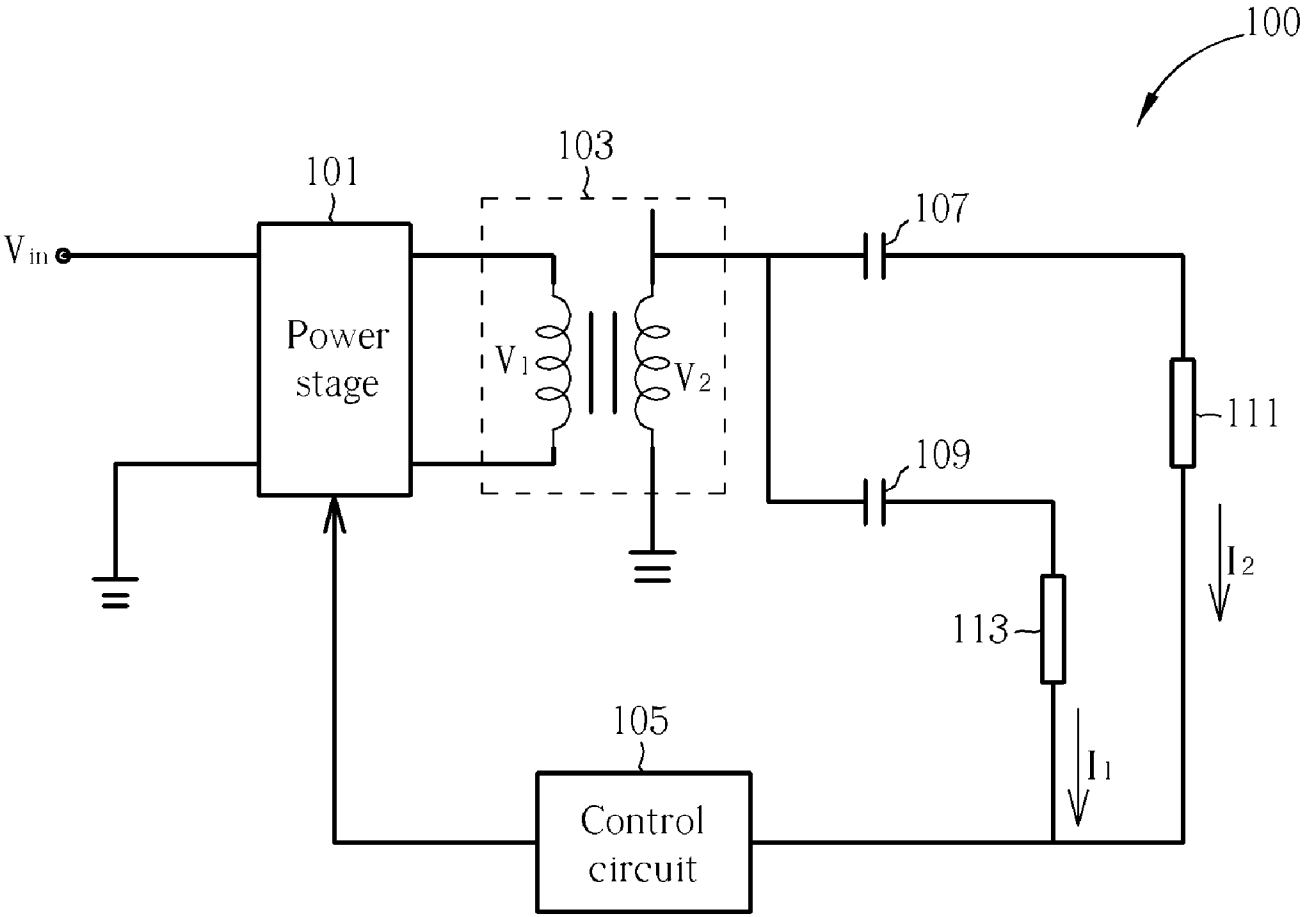
Fig. 1 Prior Art
FIG. 1 illustrates a prior art current balancing circuit for lamps.
Figure 2:
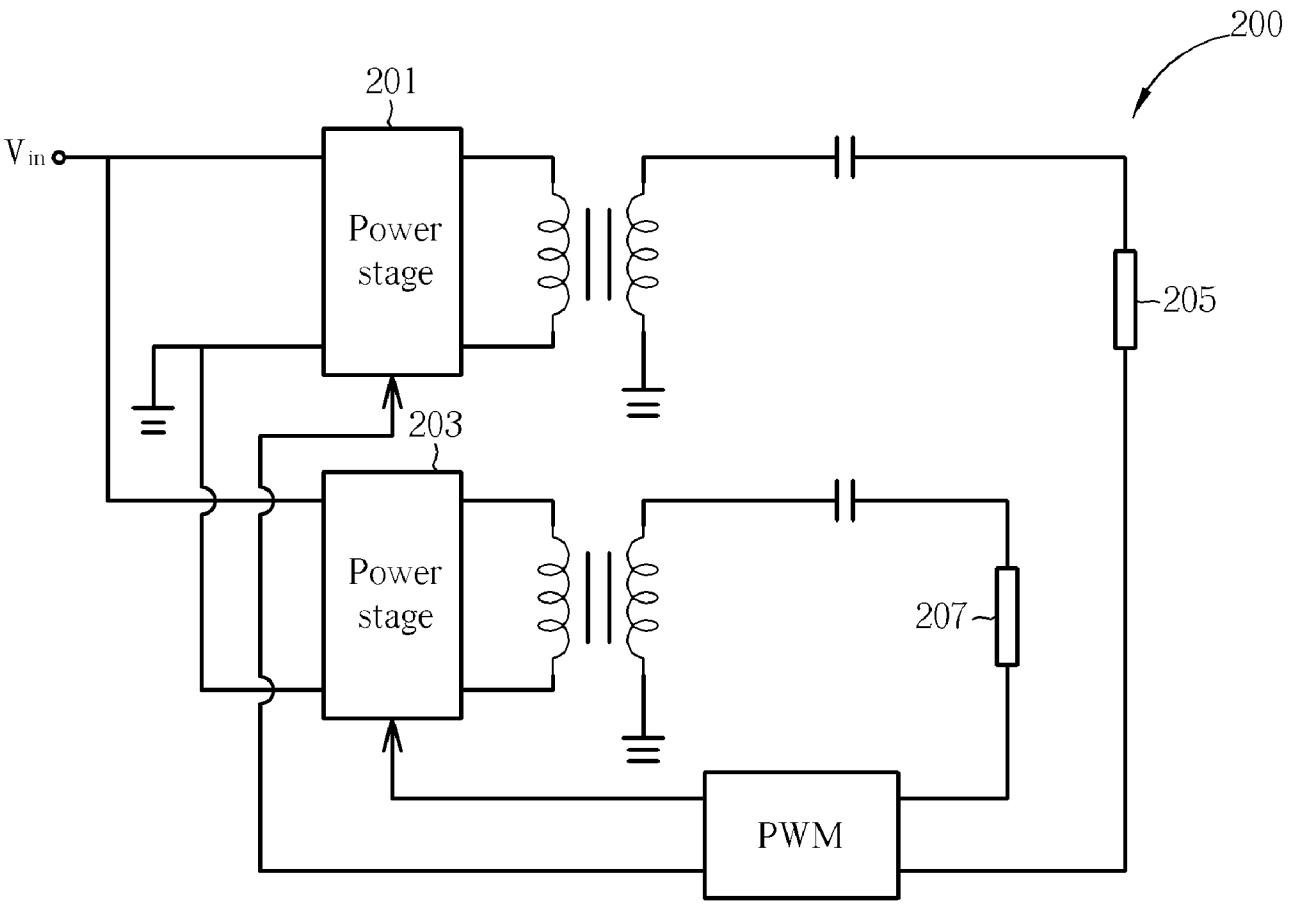
Fig. 2 Prior Art
FIG. 2 illustrates another prior art current balancing circuit for lamps.
Figure 3:
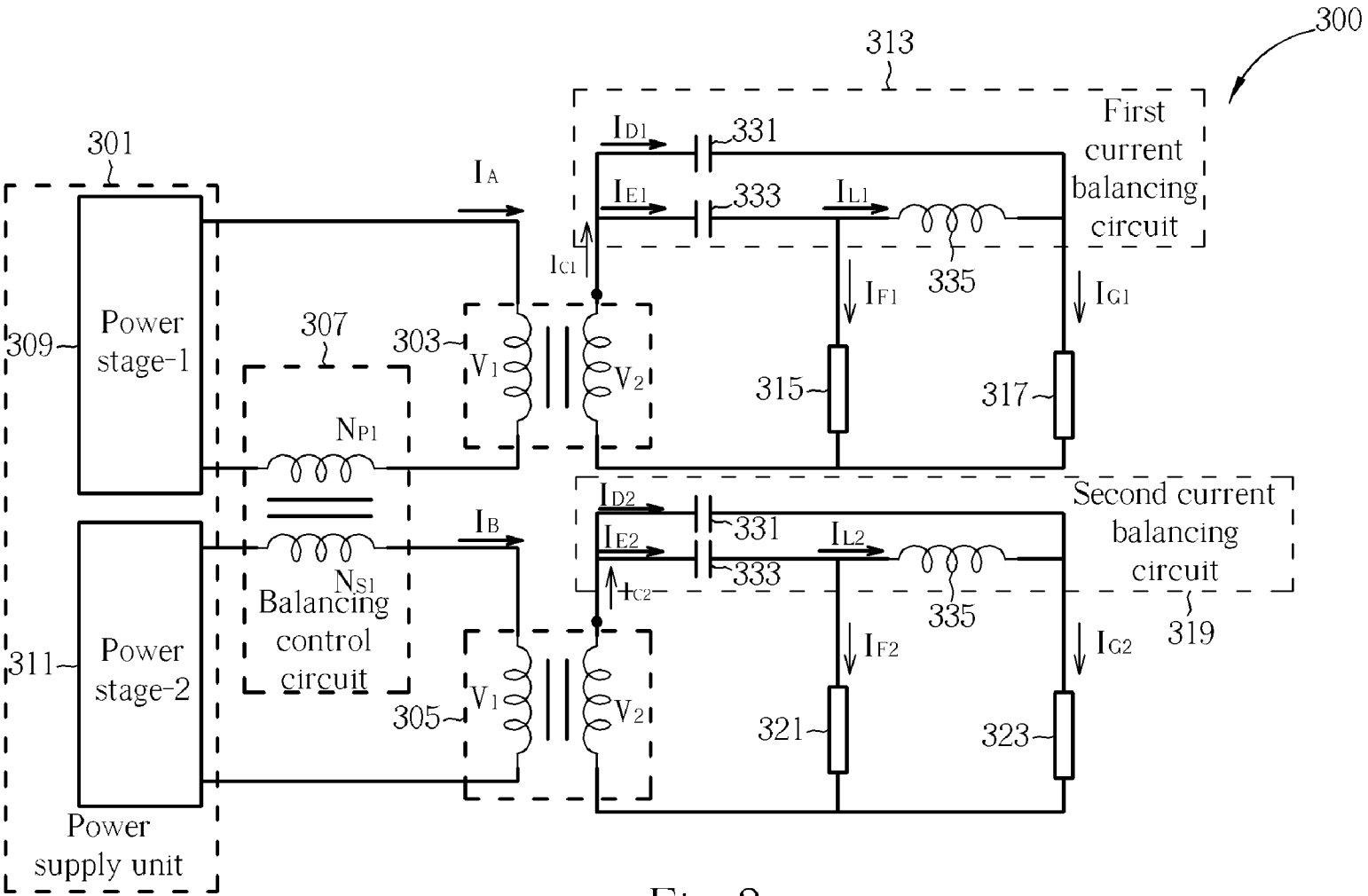
FIG. 3 is a circuit diagram illustrating a current balancing circuit according to a first embodiment of the present invention.

FIG. 3 is a circuit diagram illustrating a driving system 300 according to a first embodiment of the present invention. As shown in FIG. 3, the driving system 300 includes a power supply unit 301, a first transformer 303, a second transformer 305 and a balancing control circuit 307. The power supply unit 301 comprising a first power stage 309 and a second power stage 311 for providing a first current $I_A$ and a second current respectively $I_B$. The first transformer 303 has a primary side coupled to the first power stage 309 and a secondary side coupled to a first current balancing circuit 313 for driving a plurality of lamps 315 and 317. The second transformer 305 has a primary side coupled to the second power stage 311 and a secondary side coupled to a second current balancing circuit 319 for driving lamps 321 and 323. The balancing control circuit 307 is coupled to the power supply unit for balancing the first and the second currents $I_A$ and $I_B$ so that they are substantially equal. It should be noted that although the power supply unit 301 includes two power stages in this embodiment, but it can have other structures to reach the same function.

In the embodiment shown in FIG. 3, the balancing control circuit 307 can be a balancing transformer having a primary side coupled to the first power stage 309 and a secondary side coupled to the second power stage 311. Preferably, the primary side and the secondary side of the balancing transformer have the same number of coils.

The mechanism of the driving system 300 can be clearly understood via the following equations:

$I_A \times N_{p1} = I_B \times N_{s1}$ therefore if $N_{p1}$ is set to equal $N_{s1}$, then $$I_A = I_B = I_3 \tag{1}$$

In this equation, $N_{p1}$, $N_{s1}$ are the coil numbers of two sides of the balancing circuit 307.

$$I_{C1} = \frac{I_A}{N},\ I_{C2} = \frac{I_B}{N} \tag{2}$$

if $$I_A = I_B,$$

then $$I_{C1} = I_{C2}$$

N indicates the ratio of the coil numbers between the primary side and the secondary side of transformers 321 and 323

$$I_{D1} = I_{G1} - I_{L1},\ I_{E1} = I_{F1} + I_{L1},\ I_{C1} = I_{D1} + I_{E1} = I_{G1} + I_{F1},\ \text{therefore if } I_{G1} = I_{F1}, \text{ then } I_{C1} = 2I_{G1} = 2I_{F1} \tag{3}$$

$$I_{D2} = I_{G2} - I_{L2},\ I_{E2} = I_{F2} + I_{L2},\ I_{C2} = I_{D2} + I_{E2} = I_{G2} + I_{F2},\ \text{if } I_{G2} = I_{F2}, \text{ then } I_{C2} = 2I_{G2} = 2I_{F2} \tag{4}$$

According to equation (1)~(4), equation (5) can be obtained $$I_{G1} \approx I_{G2} \approx I_{F1} \approx I_{F2} \tag{5}$$

According to the above-mentioned equations, it can be shown that the current balancing circuit 313 and 314 shown in FIG. 3 can provide the same currents to the lamps. It should be noted that the above-mentioned structures of the power supply unit 301, the balancing control circuit 307, the first current balancing circuit 313 and the second current balancing circuit 319 are only examples and are not meant to limit the scope of the present invention. Also, the driving system 300 is not limited to be utilized for lamps, but can also be utilized for other lighting devices, and even for other electronic devices besides lighting devices.

In this embodiment, each of the first current balancing circuit 303 and second current balancing circuit 305 comprises two capacitors 331, 333 and an inductance 335. The two capacitors 331, 333 are coupled between the secondary side of the transformers 303 and 309, and a plurality of lamps 315, 317, 321, and 323, and the inductance 335 is coupled between the capacitors 331 and 333. It does not mean to limit the scope of the present invention, of course, persons skilled in the art can utilize other structures to reach the same function.

Figure 4:
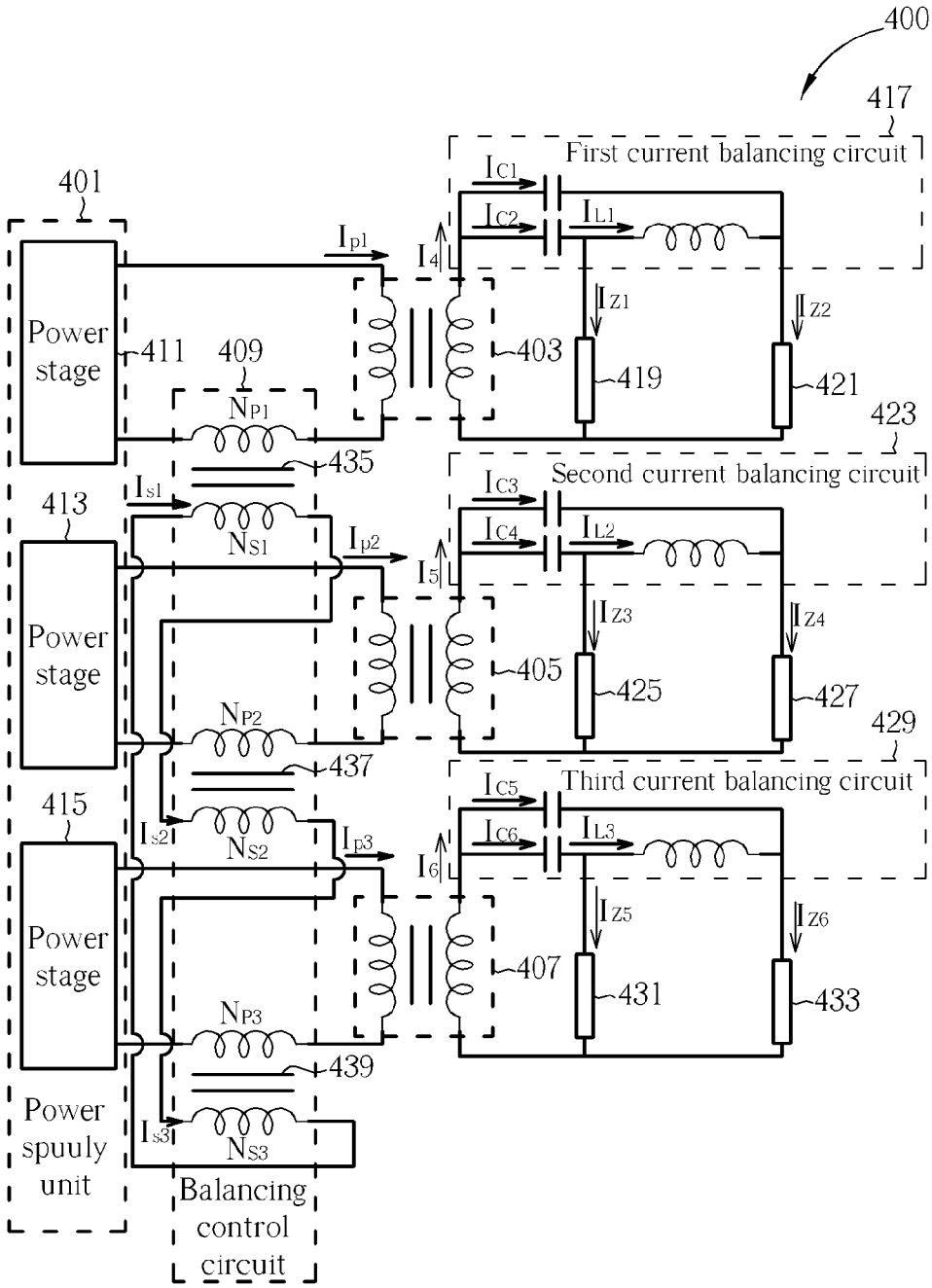
FIG. 4 is a circuit diagram illustrating a current balancing circuit according to a second embodiment of the present invention.

The structures shown in FIG. 3 can be extended as the structures shown in FIG. 4. FIG. 4 is a circuit diagram illustrating a driving system 400 according to a second embodiment of the present invention. The driving system 400 includes: a power supply unit 401, a first transformer 403, a second transformer 405, a third transformer 407, and a balancing control circuit 409. The power supply unit 401 includes a first power stage 411, a second power stage 413 and a third power stage 415 for providing a first current $I_{P1}$, a second current $I_{P2}$ and a third current $I_{P3}$ respectively. The first transformer 403 has a primary side coupled to the first power stage 411 and a secondary side coupled to a first current balancing circuit 417 for driving a plurality of first lamps 419 and 421. The second transformer 405 has a primary side coupled to the second power stage 413 and a secondary side coupled to a second current balancing circuit 423 for driving a plurality of second lamps 425 and 427. The third transformer 429 has a primary side coupled to the third power stage 415 and a secondary side coupled to a third current balancing circuit 429 for driving a plurality of third lamps 431 and 433.

In this embodiment, the balancing control circuit 409 comprises a first, a second and a third balancing transformers 435, 437 and 439. Each of the first, second and third balancing transformers 435, 437 and 439 has a primary side and a secondary side. Also, each primary side of the first, second and third balancing transformers 435, 437 and 439 is respectively coupled to the first, the second and the third power stage 411, 413 and 415, and each secondary side of the first, second and third balancing transformers 435, 437 and 439 forming a closed loop so that the first, the second and the third currents are substantially equal.

The mechanism of the driving system 400 can be clearly understood via the following equations:

$$I_{P1} \times N_{P1} = I_{S1} \times N_{S1} \rightarrow I_{P1} = \frac{N_{S1}}{N_{P1}} \times I_{S1} \tag{6}$$

$$I_{P2} \times N_{P2} = I_{S2} \times N_{S2} \rightarrow I_{P2} = \frac{N_{S2}}{N_{P2}} \times I_{S2} \tag{7}$$

$$I_{P3} \times N_{P3} = I_{S3} \times N_{S3} \rightarrow I_{P3} = \frac{N_{S3}}{N_{P3}} \times I_{S3} \tag{8}$$

According to equations (6), (7), (8)

If the driving system 400 is designed to make $$\frac{N_{S1}}{N_{P1}} = \frac{N_{S2}}{N_{P2}} = \frac{N_{S3}}{N_{P3}}$$

and $I_{S1} = I_{S2} = I_{S3}$, then $$I_{P1} = I_{P2} = I_{P3} \tag{9}$$

$I_4 = I_{C1} + I_{C3} = I_{Z2} - I_{L1} + I_{Z1} + I_{L1} = I_{Z1} + I_{Z2}$ similarly $I_5 = I_{Z3} + I_{Z4}$. $I_6 = I_{Z5} + I_{Z6}$ if $I_{Z1} = I_{Z2}$, $I_{Z3} = I_{Z4}$, $I_{Z5} = I_{Z6}$ then $$I_4 = 2I_{Z1},\ I_5 = 2I_{Z3},\ I_6 = 2I_{Z5} \tag{10}$$

$$I_4 = \frac{I_{P1}}{N},\ I_5 = \frac{I_{P2}}{N},\ I_6 = \frac{I_{P3}}{N} \tag{11}$$

According to equation (9), $I_{P1}=I_{P2}=I_{P3}$, thus $$I_4=I_5=I_6 \tag{12}$$

According to equations (12) and (10)

$$I_{Z1}=I_{Z3}=I_{Z5}=I_{Z2}=I_{Z4}=I_{Z6}$$

Therefore, according to equations (6)~(12), the driving system 400 can provide the same currents to the lamps.

Figure 5:
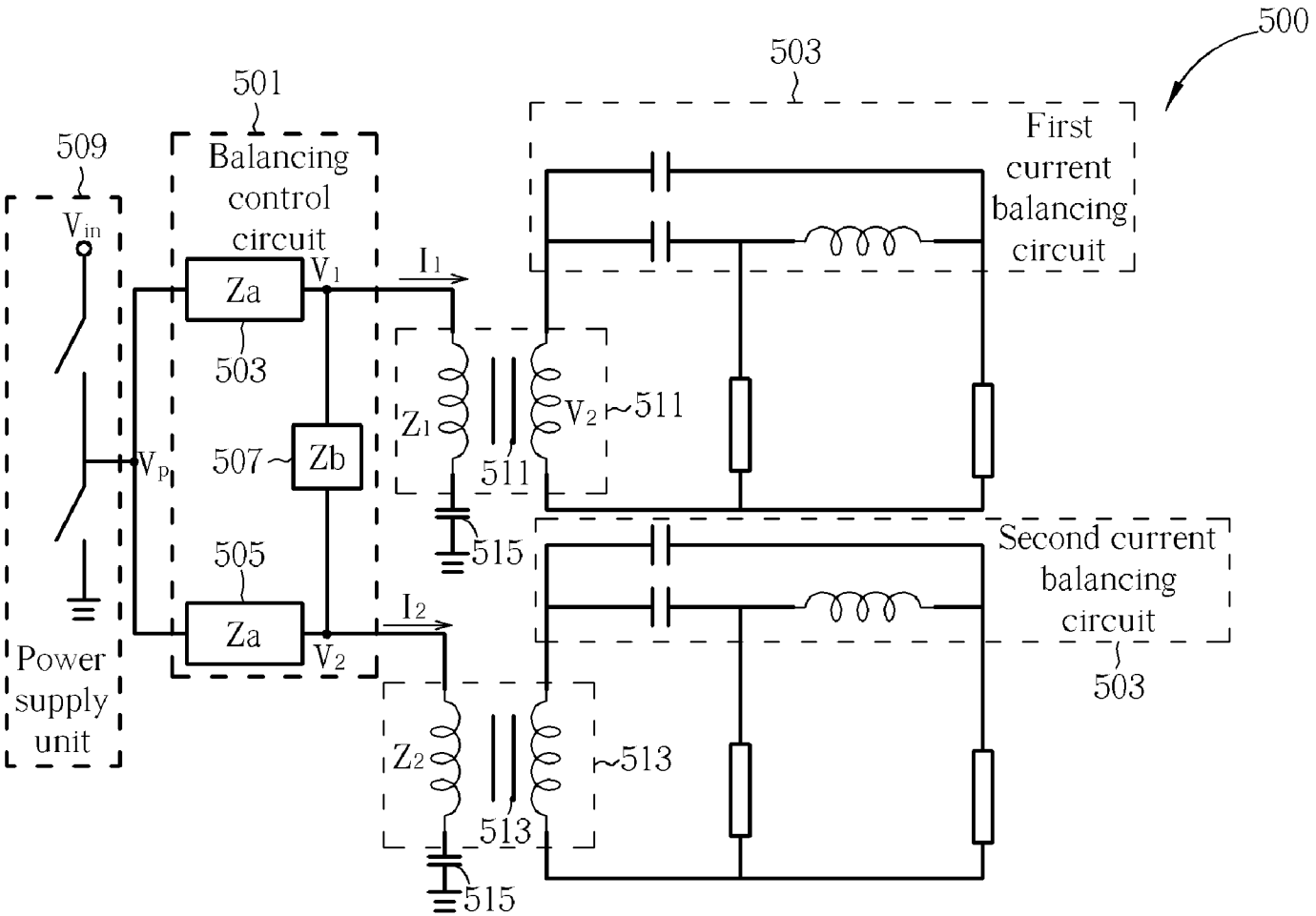
FIG. 5 is a circuit diagram illustrating a current balancing circuit according to a third embodiment of the present invention.

Also, the balancing control circuit and the power supply unit can have different structures from FIG. 3 and FIG. 4. FIG. 5 is a circuit diagram illustrating a driving system 500 according to a third embodiment of the present invention. In this embodiment, the balancing control circuit 501 includes a first impedance 503, a second impedance 505, and a third impedance 507. The first impedance 503 is coupled to the power unit 509 and the primary side of the first transformer 511. The second impedance 505 is coupled to the power unit 509 and the primary side of the second transformer 513. The third impedance 507 is coupled between the primary side of the first transformer 511 and the primary side of the second transformer 513. The first, the second and the third impedance are adapted to balance the first and the second current, so that the first current $I_1$ and the second current $I_2$ are substantially equal.

In this embodiment, the driving system 500 can further comprise capacitors 515 and 517. Also, the power supply unit 509 comprises switches between a voltage level $V_{in}$ and a ground, such that a voltage level Vp can be provided. The operation of the driving system 500 can be clearly understood via the following equations, wherein $Z_a$ indicates the impedance value of the first impedance 505 and the second impedance 505, $Z_b$ indicates the impedance value of the third impedance 507, $Z_1$ indicates the impedance value of the first primary side of the first transformer 511 and the capacitor 515, and $Z_2$ indicates the impedance value of the first primary side of the second transformer 513 and the capacitor 517:

$$I_4 = \frac{V_1 - V_2}{Z_b} = \frac{I_1 \times Z_1 - I_2 \times Z_2}{Z_b} \tag{13}$$

$$V_1=I_1\times Z_1,\ V_2=I_2\times Z_2,\ V_O=I_1(Z_a+Z_1)+I_2\times Z_a=I_2(Z_a+Z_2)-I_2\times Z_a$$

$$I_1(Z_a+Z_1)+2I_2\times Z_a=I_2(Z_a+Z_2) \tag{14}$$

If equation (13) is substituted into equation (14)

$$I_1 \times Z_a + I_1 \times Z_1 + \frac{2Z_a}{Z_b}(I_1 \times Z_1 - I_2 \times Z_2) = I_2(Z_a + Z_2)$$

$$I_1 \times Z_a + I_1 \times Z_1 + \frac{2I_1Z_1Z_a}{Z_b} = I_2 \times Z_a + I_2 \times Z_2 + \frac{2I_2Z_2Z_a}{Z_b}$$

$$I_1\left(Z_a + Z_1 + \frac{2Z_1 \times Z_a}{Z_b}\right) = I_2\left(Z_a + Z_2 + \frac{2Z_2 \times Z_a}{Z_b}\right)$$

If $I_1=I_2$, $Z_a\times Z_b+Z_1\times Z_b+2Z_1\times Z_a=Z_a\times Z_b+Z_2\times Z_b+2Z_2\times Z_a$ $$2Z_1\times Z_a-2Z_2\times Z_a=Z_2\times Z_b-Z_1\times Z_b,\ -2Z_a(-Z_1+Z_2)=Z_b(-Z_1+Z_2)$$

$$\frac{-2Z_a}{Z_b} = 1,\ \frac{Z_a}{Z_b} = \frac{-1}{2}$$

Therefore if $$\frac{Z_a}{Z_b} = \frac{-1}{2},$$

then $I_1=I_2$. If $I_1=I_2$, than the lamps of the driving system 500 can obtain the same currents.

If $Z_a$ indicates the impedance of a capacitor, and $Z_b$ indicates the impedance of an inductance, then $$\frac{\frac{1}{j\omega C}}{j\omega L} = -\frac{1}{2},\ \frac{-1}{\omega^2 LC} = -\frac{1}{2},\ \frac{1}{LC} = \frac{\omega^2}{2},$$

therefore if $$\frac{1}{LC} = \frac{\omega^2}{2},$$

then $$I_1 = I_2.$$

It should be noted that besides the structures shown in FIG. 3, FIG. 4 and FIG. 5, the power supply unit 509 can have a DC/AC inverter to provide AC power.

According to the above-mentioned circuit, the current balancing circuit can provide the same currents to the lamps without increasing the complexity of the circuit.

Those skilled in the art will readily observe that numerous modifications and alterations of the device and method may be made while retaining the teachings of the invention.

What is claimed is:

1. A driving system, comprising:

a power supply unit for providing a first current and a second current;

a first transformer having a primary side coupled to the power supply unit and a secondary side coupled to a first current balancing circuit for driving a plurality of first lamps, wherein the first current balancing circuit comprises at least two capacitors and an inductance, the two capacitors are coupled between an output terminal of the first transformers and the first lamps, and the inductance is coupled between the capacitors;

a second transformer having a primary side coupled to the power supply unit and a secondary side coupled to a second current balancing circuit for driving a plurality of second lamps;

a balancing control circuit coupled to the power supply unit for balancing the first and the second current so that the first current and the second current are substantially equal.

2. A driving system, comprising:

a power supply unit for providing a first current and a second current;

a first transformer having a primary side coupled to the power supply unit and a secondary side coupled to a first current balancing circuit for driving a plurality of first lamps;

a second transformer having a primary side coupled to the power supply unit and a secondary side coupled to a second current balancing circuit for driving a plurality of second lamps;

a balancing control circuit coupled to the power supply unit for balancing the first and the second current so that the first current and the second current are substantially equal, comprising a first impedance coupled to the power unit and the primary side of the first transformer, a second impedance coupled to the power unit and the primary side of the second transformer and a third impedance coupled between the primary side of the first transformer and the primary side of the second transformer for balancing the first and the second current so that the first current and the second current are substantially equal.

3. The system as claimed in claim 2, further comprising:

a first capacitor, coupled between a primary side of the first transformer and a ground level; and a second capacitor, coupled between a primary side of the second transformer and the ground level.

4. A driving system, comprising:

a power supply unit comprising a first power stage, a second power stage and a third power stage for providing a first current, a second current and a third current respectively;

a first transformer having a primary side coupled to the first power stage and a secondary side coupled to a first current balancing circuit for driving a plurality of first lamps;

a second transformer having a primary side coupled to the second power stage and a secondary side coupled to a second current balancing circuit for driving a plurality of second lamps;

a third transformer having a primary side coupled to the third power stage and a secondary side coupled to a third current balancing circuit for driving a plurality of third lamps;

a balancing control circuit comprising a first, a second and a third balancing transformers, each of the first, second and third balancing transformer having a primary side and a secondary side, wherein each primary side of the first, second and third balancing transformer respectively coupled to the first, the second and the third power stage and each secondary side of the first, second and third balancing transformer forming a closed loop so that the first, the second and the third currents are substantially equal.

5. The system as claimed in claim 4, wherein the first current balancing circuit comprises at least two capacitors and an inductance, the two capacitors are coupled between an output terminal of the first transformers and the first lamps, and the inductance is coupled between the capacitors.

6. The system as claimed in claim 4, wherein at least one of the first second and third power stages comprising an inverter.

7. The system as claimed in claim 4, wherein the first, second or third lamps are disposed in a backlight module.

8. A driving system, comprising:

a power supply unit for providing a first current and a second current, comprising a first power stage and a second power stage for providing the first current and the second current respectively;

a first transformer having a primary side coupled to the power supply unit and a secondary side coupled to a first current balancing circuit for driving a plurality of first lamps;

a second transformer having a primary side coupled to the power supply unit and a secondary side coupled to a second current balancing circuit for driving a plurality of second lamps, where the first and second transformers are coupled to the first power stage and the second power stage respectively;

a balancing control circuit coupled to the power supply unit for balancing the first and the second current so that the first current and the second current are substantially equal, comprising a balancing transformer having a primary side coupled to the first power stage and a secondary side coupled to the second power stage.

9. The system as claimed in claim 8, wherein the primary side and the secondary side of the balancing transformer have the same number of coils.

10. The system as claimed in claim 8, wherein at least one of the first and second power stage comprising an inverter.

11. The system as claimed in claim 8, wherein the first or second lamps are disposed in a backlight module.

12. The system as claimed in claim 8, wherein the first current balancing circuit comprises at least two capacitors and an inductance, the two capacitors are coupled between an output terminal of the first transformers and the first lamps, and the inductance is coupled between the capacitors.

13. The system as claimed in claim 8, wherein the balancing control circuit comprising a first impedance coupled to the power unit and the primary side of the first transformer, a second impedance coupled to the power unit and the primary side of the second transformer and a third impedance coupled between the primary side of the first transformer and the primary side of the second transformer for balancing the first and the second current so that the first current and the second current are substantially equal.

14. The system as claimed in claim 13, further comprising:

a first capacitor, coupled between a primary side of the first transformer and a ground level; and a second capacitor, coupled between a primary side of the second transformer and the ground level.

* * * * *